United States Patent [19]

Ver Strate et al.

[11] Patent Number: 4,620,048

[45] Date of Patent: Oct. 28, 1986

[54] HYDROCARBON SOLUTIONS OF MACROMOLECULAR POLYMERS HAVING AN IMPROVED RESISTANCE TO MECHANICAL DEGRADATION

[75] Inventors: Gary W. Ver Strate, Matawan, N.J.; William W. Graessley, Evanston, Ill.; Edward N. Kresge, Watchung, N.J.

[73] Assignee: Exxon Research & Engineering Co., Florham Park, N.J.

[21] Appl. No.: 601,376

[22] Filed: Apr. 17, 1984

Related U.S. Application Data

[63] Continuation of Ser. No. 356,364, Mar. 9, 1982, abandoned, which is a continuation of Ser. No. 179,022, Aug. 18, 1980, abandoned, which is a continuation-in-part of Ser. No. 27,996, Apr. 9, 1974, abandoned.

[30] Foreign Application Priority Data

Mar. 26, 1980 [GB] United Kingdom ..... 8010190

[51] Int. Cl.[4] ..... C10M 1/28

[52] U.S. Cl. ..... 585/10; 585/11; 585/12; 585/13; 208/18; 208/19; 252/56 R; 252/56 S; 252/52 A

[58] Field of Search ..... 585/10, 11, 12, 13; 208/18, 19; 252/56 R, 56 S, 52 A

[56] References Cited

U.S. PATENT DOCUMENTS

| | | | |
|---|---|---|---|
| 3,522,180 | 7/1970 | Sweeney et al. | 252/59 |
| 3,551,336 | 12/1970 | Jacobson et al. | 252/59 |
| 3,790,480 | 2/1974 | Campbell et al. | 585/12 |
| 3,814,690 | 6/1974 | Song | 585/11 X |
| 3,948,843 | 4/1976 | Saint-Pierre et al. | 585/11 X |
| 4,077,893 | 3/1978 | Kiovsky | 252/56 R |
| 4,156,767 | 5/1979 | Hall | 526/282 |

FOREIGN PATENT DOCUMENTS

| | | |
|---|---|---|
| 0000648A1 | 2/1979 | European Pat. Off. . |
| 0002286A2 | 6/1979 | European Pat. Off. . |
| 53-18201 | 6/1978 | Japan . |
| 1337475 | 11/1973 | United Kingdom . |
| 1359067 | 7/1974 | United Kingdom . |
| 1419853 | 12/1975 | United Kingdom . |
| 1441949 | 7/1976 | United Kingdom . |
| 1442409 | 7/1976 | United Kingdom . |
| 1525402 | 9/1978 | United Kingdom . |
| 1538350 | 1/1979 | United Kingdom . |
| 2003484A | 3/1979 | United Kingdom . |
| 1548525 | 7/1979 | United Kingdom . |
| 2015547A | 9/1979 | United Kingdom . |
| 2015538A | 9/1979 | United Kingdom . |
| 2015537A | 9/1979 | United Kingdom . |
| 1558991 | 1/1980 | United Kingdom . |
| 1559952 | 1/1980 | United Kingdom . |
| 2040296A | 8/1980 | United Kingdom . |
| 1575507 | 9/1980 | United Kingdom . |

*Primary Examiner*—John Kight
*Assistant Examiner*—M. L. Moore
*Attorney, Agent, or Firm*—F. T. Johmann; E. T. Wheelock

[57] ABSTRACT

Fluid solutions, e.g. mineral oil solutions, of polydispersed polymers have improved resistance to mechanical shear when said polymers have a narrow molecular weight distribution, i.e.

$$\frac{(\overline{M}_z)\,(\overline{M}_{z+1})}{(\overline{M}_w)^2}$$

10 and/or a reduced compliance less than that of a linear monodisperse polymer of the same chemical repeat unit and $\overline{M}_w$ and preferably said solution at a concentration such that $[\eta]$ c ranges from one-tenth to five where $[\eta]$ is the intrinsic viscosity of the polymer in the oil and c is the concentration in the same units and/or has a compliance no larger than twenty times the value exhibited by an identical solution except that said polymer was replaced by a linear monodisperse polymer of the same chemical structure and of the same (±5%) weight average molecular weight ($\overline{M}_w$).

10 Claims, No Drawings

HYDROCARBON SOLUTIONS OF MACROMOLECULAR POLYMERS HAVING AN IMPROVED RESISTANCE TO MECHANICAL DEGRADATION

RELATED APPLICATION

This application is a continuation of Ser. No. 356,364 filed Mar. 9, 1982, now abandoned, which was a continuation of Ser. No. 179,022 filed Aug. 18, 1980, now abandoned, which was a continuation-in-part of Ser. No. 27,996, filed Apr. 9, 1974, now abandoned.

BACKGROUND OF THE INVENTION

This invention relates to hydrocarbon solutions of polymers having improved resistance to mechanical shear and the preparation thereof. More particularly, it relates to viscosity index improving additives for mineral oils of lubricating viscosity by the addition thereto of macromolecules whereby the mineral oil is provided with increased resistance to mechanical degradation of the viscosity of said lubricating oil composition.

DESCRIPTION OF THE PRIOR ART

As is well known to those skiled in the art, lubricating oils may be evaluated by many criteria each of which relates to the proposed use of the oil. One of the more important of these criteria is the viscosity index.

It is known that the viscosity index of lubricating oils can be usefully modified by the addition of oil-soluble polymeric viscosity index (V.I.) improvers such as polyesters and polyolefins, e.g. butadiene-dieneisoprene copolymers, polyisobutylenes and ethylene copolymers including ethylene-higher alpha-olefin copolymers and terpolymers; however, such an addition can introduce chemical instability.

Recently, ethylene-propylene copolymers have become widely used as viscosity improvers in lubricating oils because of the low treat levels and improved viscometric properties.

The patent literature is replete with many publications dealing with ethylene copolymers including tri- and tetrapolymers containing one or more types of dienes introduced for a variety of reasons including a means to introduce branchiness into the ethylene polymer and to provide a means for crosslinking said polymer through introduction of a crosslinking agent reactive with a portion of said diene. Those patents, however, dealing with ethylene tri- and tetrapolymers added to a mineral oil is a viscosity index modifying additive are of limited number and are best illustrated by the specification of U.S. Pat. No. 3,790,480. This specification teaches of ethylene ter- and tetrapolymers involving ethylene, a $C_3$ to $C_{18}$ higher alpha-olefin, for example, propylene, and two classes of dienes based upon the relative polymerizabilities of each of the double bonds. In one class of dienes (as represented by 1,4-hexadiene) only one of the double bonds is readily polymerizable whereas in the other class (as represented by 2,5-norbornadiene) both double bonds are readily polymerizable. It is taught therein that an ethylene polymeric viscosity index additive for mineral oils is superior when and if it is an ethylene tetrapolymer containing both classes of dienes rather than the prior art ethylene terpolymer containing the class of dienes having only one readily polymerizable double bond. Allegedly, this superiority obtains because the introduction of the second diene comonomer with two readily polymerizable double bonds into the terpolymer composition provides a significant increase in bulk polymer viscosity with only a minor increase of the inherent viscosity (see col. 8, lines 23–30) and without degradation of the property of the terpolymer to provide viscosity index improvement to mineral oils. Although believed misleading U.S. Pat. No. 3,790,480 teaches (col. 6, lines 22–28) the optimum shear stability is achieved with ethylene copolymers when the molecular weight distribution is relatively narrow [preferably when $\overline{M}_w/\overline{M}_n$ is less than about 8—as used therein ($\overline{M}_w$) and ($\overline{M}_n$) are measued by the well-known techniques of vapor pressure (VPO) and membrane osmometry and light scattering, respectively.] Unfortunately, these polymers as well as ethylene-propylene copolymers generally in lubricating oil solutions are materially mechanically degraded during lubrication of the operating device and/or machine by exposure to the shear and operational stresses resulting in instability and/or reduction of the viscosity modifying activity of the ethylene copolymers.

This mechanical shear degradation of polymers in solution is not limited to the ethylene copolymers but to polymers in general including these other types of known V.I. improving polymers including polybutadienes, polystyrene and polyesters as is apparent from a U.S. Department of Commerce National Technical Information Service Publication No. AD-A038139 of June 1976 entitled "Mechanical Shear Degradation of Polymers in Solution: A Review by J. Knight" or "Polymer Stress Reactions" A. Casale, R. Porter Academic Press 1978. In these state of the art reviews, an attempt is made to correlate shear stability with molecular parameters, such as the effects of molecular weight MW and molecular weight distribution MWD, solvent, concentration and structure of repeat unit. With regard to molecular weight distribution, it is stated that polymers above a critical molecular weight will rupture under a given stress leading to a narrowing of the molecular weight distribution. With regard to polymer type, it is believed that degradation is correlated with the strength of bonds and degree of chain flexibility. Nothing is concluded about molecular topology. By topology we mean the connectivity of polymer backbone's contour e.g. linear, large and/or flexible ring or long chain branch containing polymers, said rings or branches will generally contain 100 or more backbone carbon atoms.

With regard to molecular topology, in U.S. Pat. No. 4,077,893, it is stated that the viscosity index of lubricating oils can be improved by a two-block copolymer of styrene and hydrogenated isoprene or a hydrogenated "star-branched" type polymer (which is a unique topological type) claimed to have greatly improved mechanical shear stability which polymer may or may not be reacted with an alkane polyol having at least two hydroxy groups (see col. 1, lines 10–18 and 50–55). No explanation of this polymer's claimed superiority is given.

It is an object of this invention to provide polymer solutions having viscosity index improving activity for mineral oils of lubricating viscosity which have increased resistance to mechanical degradation. More particularly, it is an object of this invention to provide polymer solutions of improved resistance to mechanical stress over that exhibited by polymer solutions formulated from polymers of equivalent thickening efficiency and the same chemical repeat units.

SUMMARY OF THE INVENTION

It has been discovered that solutions of polymers at a concentration such that $[\eta]c$ ranges from one-tenth to five (where $[\eta]$ is the intrinsic viscosity of the polymer in the oil and c is the concentration in the same units e.g. if $[\eta]$ is in ml/gm then c must be gm/ml) exhibit increased or enhanced stability to viscosity loss to polymer degradation when this solution is subjected to mechanical stress, if the compliance of said solution is no larger than twenty, preferably 10, times the value exhibited by a linear monodisperse polymer of the same chemical structure and of the same weight average molecular weight ($\overline{M}_w$).

Thus, the above objective can be met by a lubricating composition which comprises, according to this invention, a mineral oil of lubricating viscosity and at least a viscosity index improving amount of an oil-soluble macromolecular polymer of weight average molecular weight of from about $10^4$ to $10^7$, said polymer being characterized by providing an oil solution which at a concentration such that $[\eta]c$ ranges from one-tenth to five provides a compliance of said macromolecular polymeric solution no larger than 20, preferably 10, optimally 5, more optimally 3 or even two times the value exhibited by a linear monodisperse polymer of the same chemical structure as said macromolecular polymer and of the same weight average molecular weight (all $\overline{M}_w$ herein are determined by light scattering techniques). The actual value selected for the limit for the compliance will be determined by the thickening efficiency, severity of use condition and acceptable limits on degradation for the use. This invention teaches how to meet the criteria once a permissible degradation level is secured which value for purposes of V.I. improving activity has been selected as a maximum value of 20 (it must be realized that the lower value of the range can be less than 1 and for this reason only the upper limit (value) has been defined).

Implicit in this discovery that the control of the compliance level of polymer solutions at a given viscosity modification level makes for improved mechanical shear resistance of said solutions, is a finding that said resistance is a function of both the molecular weight distribution (MWD) of and the molecular topology of said polymer. For purposes of this disclosure, the compliance $J_e^\circ$ is set forth in the following equation:

$$J_e^\circ = \frac{J_{eR}^\circ}{cRT} \cdot \frac{\overline{M}_z\overline{M}_{z+1}}{\overline{M}_w^2} \cdot \frac{(\eta^\circ - \eta_s)^2}{\eta^{\circ 2}}$$

wherein $J_{eR}^\circ$ is the reduced compliance which depends on molecular topology. $J_{eR}^\circ$ can be determined experimentally and estimated theoretically in the prescribed concentration range. (See for example J. S. Ham, *J. Chem. Phys.*, 26 625 (1957).

In the equation $\eta^\circ$ is the viscosity of the polymer solution at concentration c; $\eta_s$ is the viscosity of the unmodified oil; T is temperature; and, R is the gas constant.

$J_e^\circ$ can be measured experimentally as a so-called elastic parameter of a fluid and is related to the normal stresses exerted in flow as $$J_e^\circ = \lim_{\gamma \to 0} \tfrac{1}{2}\left(\frac{1}{\eta^\circ}\right)^2 \cdot \left(\frac{P_{11} - P_{22}}{\gamma^2}\right)$$

where $\gamma$ is the strain rate and $P_{11}-P_{22}$ is the first normal stress difference (see for example W. W. Graessley *Adv. Polymer Sci.*, 16, 60 (1974)).

$\overline{M}_z$, $\overline{M}_{z+1}$ and $\overline{M}_w$ are molecular weight averages, see for example, "Science and Technology of Rubber", F. Eirich, editor, Wiley 1978, p. 83ff. These molecular weight averages may be determined by a combination of gel permeation chromatography and on-line light scattering forming the sums over the chromatogram as $$\Sigma_i c_i(\overline{R}_{\theta i}/Kc_i)^a \; \Sigma_i c_i(\overline{R}_{\theta i}/Kc_i)^{a-1}$$

where a=0, 1, 2 or 3 respectively for the number, weight, z and z+1 average molecular weights, and where $c_i$ is the concentration of polymer subfraction i which has scattering intensity $\overline{R}_{\theta i}$ above that of the solvent and K is the appropriate scattering constant for the system and $\theta$ is the scattering angle, which is small; e.g. less than 5 degrees.

Alternatively these molecular weight averages may be obtained by ultracentrifugation techniques as described in the cited reference.

It will be shown that for a given $\eta^\circ$ and c, a reduction in $J_e^\circ$ correlates with improved shear stability. This variation in $J_e^\circ$ can be brought about by lowering $J_{eR}^\circ$ through branching or ring formation and/or by changing MWD (molecular weight distribution) as defined by $$\frac{\overline{M}_z\overline{M}_{z+1}}{\overline{M}w^2}.$$

The literature suggests that the useful shear stable $\overline{M}w/\overline{M}n$ range can be chosen by selection of an appropriate value wherein ($\overline{M}_n$) is the number average molecular weight. This approach is insufficient, not adequately discriminatory and/or sufficiently accurate for practice of this invention since the ratio does not articulate those polymeric structures which provide the improved resistance to mechanical stress of polymer solutions so that the advantages of the invention may be realized.

Mechanical degradation is caused by stress assisted chemical bond rupture of the polymer backbone chains. A direct measure of the stress per bond caused by flow in linear polymers is the stored energy or normal stress. Thus, for a given set of chemical constraints, concentration, and a given viscous dissipation, it is anticipated that in situations where a higher stored energy per molecule exists more degradation will occur. Since in dilute or semidilute polymer solutions, branched and loop containing polymeric structures of the same molecular weight have lower reduced compliances than do linear ones (at least in the linear viscoelastic region), it is proposed that they should degrade less. In addition to lower stored energy per molecule, the connectivity of nonlinear structures leads to lower stress per bond, e.g. four-arm star structures are anticipated to have only about half the stress per bond near the molecule's center that would be experienced by a linear molecule storing the same energy.

It is the sum of these two effects which is of importance. Since, as inferred below, non-linear molecules have lower $[\eta]$ and thus thickening efficiency for a given $\overline{M}_w$ and MWD, it is not immediately clear whether the higher $\overline{M}_w$ needed for non-linear structures to reach the same thickening efficiency as linear ones, will cause the compliance and stored energy/bond to be greater for the nonlinear molecules at the same thickening efficiency. For the particular case of star-branched molecules coupling of these effects in a calculation of the maximum stored energy per bond using the Rouse model (see J. S. Ham or W. W. Graessley references above for Rouse model) results in the following ratio of maximum stored energy per bond for branched and linear structures at the same $[\eta]$ and c:

$$\text{Maximum stored energy per bond of } \frac{\text{Branched Structure}}{\text{Linear Structure}} = \frac{(16f-1)f^2}{(3f-2)^3}$$

where f is the number of equal length arms in the star (f=2) for a linear molecule). This is a decreasing function of f indicating even at the same thickening efficiency (and MWD) star-branched structures should degrade less. Although the solution viscosity (in the prescribed $[\eta]$c range) of a branched polymer of a given molecular weight continues to decrease as the number of branches (f) increases, there is a limit to how much the stored energy per bond can be reduced. For the case at hand, with $[\eta]$ and c constant, the maximum stored energy/bond can be reduced to 16/27 of the value for a linear polymer when the number of branches becomes large. Thus one might expect reduced effectiveness of additional branching at high branching degrees. The preferred range for the degree of branching (f) is between 5 and 16. This calculation was performed for a particular branch type and molecular model for behavior in the linear viscoelastic region. Other branched and loop-containing structures should behave similarly. Similar calculations should give the proper ordering of behavior in the non-linear region. In Example 1, we show experimentally that lightly branched structures do degrade less than their linear counterparts at the same $[\eta]$ and c.

Finally, once bond rupture occurs, the rate of viscosity (and normal stress) loss per break will be less for the nonlinear structures. Thus, in dilute to semidilute solution, the viscosity increment caused by the polymer will be proportional to $[\eta]$c. It is proposed that $[\eta]_{NON\text{-}LINEAR} = f(g)\ [\eta]_{LINEAR}$ where polymers of the same molecular weight are considered and $f(g) < 1$ is a function of the molecular topology, with $g = \langle R_G^2 \rangle_{NON\text{-}LINEAR} / \langle R_G^2 \rangle_{LINEAR}$. $\langle R_G^2 \rangle$ is the mean square radius of gyration of the polymer. Since f(g) increases with g and any scission process will tend to make the average g for the polymer molecular in solution larger, one can see that the incremental change in intrinsic viscosity with the molecular weight $(d[\eta]/dM)$ will be less for nonlinear structures than for linear polymeric structures. Two additional points worth noting are that the incremental change in molecular weight with number of bond ruptures [dM/d (bond rupture)] will vary with topology and will always be less for nonlinear structures. For the first bond rupture on a ring it is zero, and $[\eta]$ will actually increase.

It is well known in polymerization reactions that both the polymeric MWD and the intrinsic viscosity of polymers can be readily manipulated by varying the reaction components and conditions. Since this knowledge is well within the ability of one skilled in the art, the text will not go into a detailed description of obtaining the desired MWD and/or intrinsic viscosity.

DETAILED DESCRIPTION OF THE INVENTION

The invention herein relates to enhancement of all types of polymer solutions generally; however, for purposes of illustration the specific teaching of the invention is directed to selected types of polymeric viscosity index (V.I.) improver additives for lubricating oil compositions which additives are characterized by the property of reducing the extent of the oil's viscosity change as a result of temperature change. These polymeric materials are oil-soluble and possess a linear and extended methylene chain (derived from the polymerization of an ethylenically unsaturated monomer) which provides for said oil-solubility. These V.I. improving polymers are hydrocarbon polymers having a $(\overline{M}_n)$ ranging from 15,000 to 10,000,000, preferably 20,000 to 2,000,000. The specific preferable range depends on the composition and topology of the polymer selected. The main hydrocarbon chain may have hydrocarbon substituents which can be connected either directly via carbon atoms or indirectly via one or more other atoms such as oxygen, sulfur, nitrogen and phosphorous although it is preferred that the connecting atom be either carbon or oxygen.

Thus, the useful hydrocarbon solutions of the invention normally contain from 0.5 to 10 weight percent polymeric viscosity index improvers which include olefin polymers such as polybutene, atactic polypropylene, ethylene-propylene copolymers including ter- and tetrapolymers, hydrogenated polymers and copolymers and terpolymers of styrene with isoprene and/or butadiene, polymers of alkyl acrylates or alkyl methacrylates, copolymers of alkyl methacrylates with N-vinyl pyrollidone or dimethylaminoalkyl methacrylate, poly(alkyl styrenes), alkylene polyethers, alkyl fumarate-vinyl acetate copolymers, post-grafted interpolymers of ethylene-propylene with an active monomer such as maleic anhydride which may be further reacted with an alcohol or an alkylene polyamine, e.g. see U.S. Pat. Nos. 4,089,794; 4,160,739; 4,137,185; or copolymers of ethylene and propylene reacted or grafted with nitrogen compounds such as in U.S. Pat. No. 4,068,056; 4,068,058; 4,146,489; 4,149,984; styrene/maleic anhydride polymers post-reacted with alcohols and amines, ethoxylated derivatives of acrylate polymers, etc.

Commonly used are oil-soluble polymers of isobutylene. Such polyisobutylenes are readily obtained in a known manner as by following the procedure of U.S. Pat. No. 2,084,501 wherein the isoolefin, e.g. isobutylene, is polymerized in the presence of a suitable Friedel-Crafts catalyst, e.g. boron fluoride, aluminum chloride, etc., at temperatures substantially below 0° C. such as at −40° C. Such polyisobutylenes can also be polymerized with a higher straight chained alpha-olefin of 6 to 20 carbon atoms as taught in U.S. Pat. No. 2,534,095 where said copolymer contains from about 75 to about 99% by volume of isobutylene and about 1 to about 25% by volume of a higher normal alpha-olefin of 6 to 20 carbon atoms.

Other polymeric viscosity index modifier systems used in accordance with this invention are: copolymers of ethylene and $C_3$–$C_{18}$ monoolefins as described in Canadian Pat. No. 934,743; copolymers of ethylene, $C_3$–$C_{12}$ monoolefins and $C_5$–$C_8$ diolefins as described in U.S. Pat. No. 3,598,738; mechanically degraded copolymers of ethylene, propylene and if desired a small amount, e.g. 0.5 to 12 wt. % of other $C_4$ to $C_{12}$ hydrocarbon mono- or diolefins as taught in U.S. Pat. No. 3,769,216 and U.K. Pat. No. 1,397,994; a polymer of conjugated diolefin of from 4 to 5 carbon atoms including butadiene, isoprene, 1,3-pentadiene and mixtures thereof as described in U.S. Pat. No. 3,312,621; random copolymers of butadiene and styrene which may be hydrogenated as described in U.S. Pat. Nos. 2,798,853 and 3,554,911; and hydrogenated block copolymers of butadiene and styrene as described in U.S. Pat. No. 3,772,169; random or block including hydrogenated (partially of fully) copolymers of butadiene and isoprene with up to 25 mol percent of a $C_8$–$C_{20}$ monovinyl aromatic compound, e.g. styrene as described in U.S. Pat. No. 3,795,615; graft copolymers of polystyrene and polyisobutylene (see U.S. Pat. No. 3,992,310); cyclohexyl-styrene interpolymers (see U.S. Pat. No. 2,478,843); 4-methyl-1-pentene interpolymers (see U.S. Pat. No. 3,320,168); esterified olefin (includes both $C_{2-4}$ alpha-olefins and styrene); alpha, beta unsaturated aliphatic acid or anhydride interpolymers (see U.S. Pat. No. 4,080,303); and graft copolymers of butadiene-styrene (see U.S. Pat. No. 4,085,055).

ETHYLENE COPOLYMERS

One subgroup of V.I. improvers useful for preparing solutions according to this invention are ethylene copolymers of from about 2 to about 98, preferably 30 to 80, optimally 38 to 70 wt.% of ethylene and one or more $C_3$ to $C_{30}$ higher alpha-olefins, preferably propylene, which have a degree of crystallinity of less than 25 wt.% as determined by X-ray and differential scanning calorimetry and have a $\overline{M}_w$ in the range of about $10^4$ to about $10^7$. These ethylene copolymers are prepared from ethylenically unsaturated hydrocarbons including cyclic, alicyclic and acyclic containing from 2 to 30 carbons. The higher alpha-olefins which may be used in the preparation of the ethylene copolymers used in the practice of this invention include those monomers which are linear, or short chain branched where the branching occurs three or more carbon atoms from the double bond. Mixtures of $C_2$ to $C_{30}$ olefins may be employed. Suitable examples of the preferred range of $C_3$ to $C_{18}$ alpha-olefins include propylene, 1-butene, 1-pentene, 1-hexene, 1-heptene, 1-octene, 1-nonene, 1-decene, 4-methyl-1-pentene, 4-methyl-1-hexene, 5-methyl-1-hexene, 4,4-dimethyl-1-pentene, 4-methyl-1-heptene, 5-methyl-1-heptene, 6-methyl-1-heptene, 4,4-dimethyl-1-hexene, 5,6,5-trimethyl-1-heptene and mixtures thereof. It is optimal, however, that the ethylene monomer be copolymerized with propylene.

Ethylene Ter- and Tetrapolymers

The terpolymers employed in the instant invention are well known. For example, ethylene-propylene non-conjugated diene terpolymers are well known articles of commerce using Ziegler-Natta catalysts. These terpolymers, which are primarily produced for use in elastomeric compositions, are characterized by the absence of chain or backbone unsaturation and contains sites of unsaturation in groups which are pendant to or are in cyclic structures outside of the main polymer chain.

Useful copolymers for the production of the solutions of this invention comprise ethylene, a $C_3$ to $C_8$ straight or branched chain alpha-olefin and a non-conjugated diene. Representative non-limiting examples of non-conjugated dienes that may be used as the third monomer in the terpolymer include:

a. Straight chain acyclic dienes such as: 1,4-hexadiene; 1,5-heptadiene, 1,6-octadiene.
b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.
c. Single ring alicyclic dienes such as: 1,4-cyclohexadiene; 1,5-cycloctadiene; 1,5-cyclododecadiene, 4-vinylcyclohexene; 1-allyl, 4-isopropylidene cyclohexane; 3-allyl-cyclopentene; 4-allyl cyclohexene and 1-isopropenyl-4-(4-butenyl) cyclohexane.
d. Multi-single ring alicyclic dienes such as: 4,4'-dicyclopentenyl and 4,4'-dicyclohexenyl dienes.
e. Multi-ring alicyclic fused and bridged ring dienes such as: tetrahydroindene; methyl tetrahydroindene; dicyclopentadiene; bicyclo (2.2.1) hepta, 2,5-diene; alkenyl, alkylidene, cycloalkenyl and cycloalkylidene norbornenes such as: 5-methylene-6-methyl-2-norbornene; 5-methylene-6,6-dimethyl-2-norbornene; 5-propenyl-2-norbornene; 5-(3-cyclopentenyl)-2-norbornene and 5-cyclohexylidene-2-norbornene.

In general, useful terpolymers contain non-conjugated dienes having 5 to 14 carbon atoms and exhibit $\overline{M}_w$ molecular weights of from $10^4$ to $10^7$. Preferred dienes include ethylidene norbornene, dicyclopentadiene, 1,4-hexadiene and 2,5-norbornadiene.

Structurally, the terpolymers suitable for the polymeric solutions of the present invention may be illustrated for various non-conjugated diene monomers as random terpolymers in which the following moieties are linked in the polymer chain in a more or less random sequence and in a varying number as illustrated in the following:

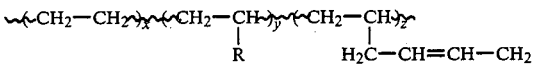

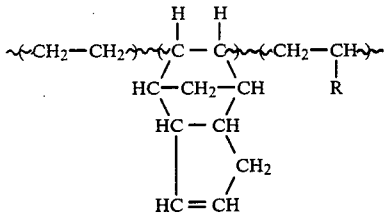

-continued

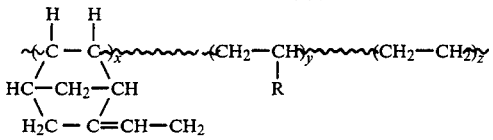

(3)

5-ethylidene 2-norbornene units | Higher alpha olefin units | Ethylene Units wherein x, y and z are cardinal numbers and R are alkyl groups. While these terpolymers are essentially amorphous in character by superficial inspection, they may contain up to about 25 percent by weight of crystalline segments as determined by X-ray or differential scanning colorimetry. Details of these methods for measurements of crystallinity are found in J. Polymer Science, A-2, 9, 127 (1971) by G. Ver Strate and Z. W. Wilchinsky.

Terpolymers, useful in the present invention contain at least 30 mol percent, preferably not more than 85 mol percent of ethylene; between about 15 and about 70 mol percent of a higher alpha-olefin or mixture thereof, preferably propylene; and between 1 and 20 mol percent, preferably 1 to 15 mol percent, of a non-conjugated diene or mixture thereof. Especially preferred are polymers of about 40 to 70 mol percent ethylene, 20 to 58 mol percent higher monoolefin and 20 to 10 mol percent diene. On a weight basis, usually the diene will be at least 2 or 3 weight percent of the total terpolymer.

Ethylene-propylene non-conjugated diolefin coplymers are known articles of commerce. In fact, various examples of such commercially available copolymers are VISTALON®, elastomeric copolymers of ethylene and propylene alone or with 5-ethylidene, 2-norbornene, marketed by Exxon Chemical Co., New York, N.Y. and Nordel®, a copolymer of ethylene, propylene and 1,4-hexadiene, marketed by E. I. duPont de Nemours & Co., Wilmington, DE.

These ethylene copolymers and terpolymers are readily prepared using soluble Ziegler-Natta catalyst compositions. For a review of the literature and patent art see: "Polyolefin Elastomers Based on Ethylene and Propylene", by F. P. Baldwin and G. Ver Strate in Rubber Chem. & Tech. Vol. 45, No. 3, 709–881 (1972) and "Polymer Chemistry of Synthetic Elastomers", edited by Kennedy and Tornqvist, Interscience, NY 1969.

Suitable copolymers may be prepared in either batch or continuous reactor systems. In common with all Ziegler-Natta polymerizations, monomers, solvents and catalyst components are dried and freed from moisture, oxygen or other constituents which are known to be harmful to the activity of the catalyst system. The feed tanks, lines and reactors may be protected by blanketing with an inert dry gas such as purified nitrogen. Chain propagation retarders or stoppers, such as hydrogen and anhydrous hydrogen chloride, may be fed continuously or intermittently to the reactor for the purpose of controlling the molecular weight and/or MWD within the desired limits and the degree of crystallinity known to be optimum for the end product.

STYRENE POLYMERS

Poly(alkylated styrene)

Those useful polymeric materials are produced by the polymerization of compounds of the formula (4)

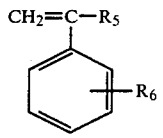

(4)

wherein $R_5$ and $R_6$ are the same or different and selected from hydrogen and alkyl radicals having from 1 to about 20, preferably from 3 to 10 carbon atoms. Compounds within the scope of formula (4) useful herein include alkyl styrenes, alpha alkyl styrenes and alpha alkyl alkylstyrenes. Of these three types of compounds alkyl styrenes are the most preferred for use herein.

Alkyl styrenes are compounds within the scope of formula (4) wherein $R_5$ is hydrogen and $R_6$ is selected from alkyl radicals having from 1 to about 20 and preferably from about 3 to about 10 carbon atoms.

Examples of alkyl styrenes useful herein include but are not limited to n-propyl styrene, i-propyl styrene, n-butyl styrene, t-butyl styrene (most preferred), n-hexyl styrene, 2-ethylhexyl styrene, n-octyl styrene, etc.

Alpha alkyl styrenes are compounds within the scope of formula (4) wherein $R_5$ is selected from alkyl radicals having from 1 to about 20, and $R_6$ is hydrogen. Examples of alpha alkyl styrenes useful herein include alpha n-butyl styrene, alpha n-pentyl styrene, alpha n-hexyl styrene (most preferred), alpha n-decyl styrene, etc.

Alpha alkyl alkylstyrenes are compounds within the scope of formula (4) wherein $R_5$ is selected from alkyl radicals having from 1 to about 20 and $R_6$ is selected from alkyl radicals having from 1 to about 20 carbon atoms.

Examples of alpha alkyl alkylstyrenes useful herein include alpha methyl n-butylstyrene, alpha methyl t-butylstyrene (most preferred), alpha methyl hexylstyrene, alpha methyl ethylhexylstyrene, alpha ethyl t-butylstyrene, alpha ethyl dodecylstyrene, alpha butyl t-butylstyrene, alpha butyl ethylhexylstyrene, alpha hexyl n-butylstyrene, alpha dodecyl methylstyrene, etc.

Styrene Copolymers

These are generally known as alkenylarene-conjugated diene interpolymers and include interpolymers of an alkenylarene monomer, such as styrene, and a conjugated diene monomer, such as butadiene, which have been preferably fully hydrogenated to remove substantially all of the olefinic unsaturation, although, in some situations, partial hydrogenation of the aromatic-type unsaturation is effected. These interpolymers are prepared by conventional polymerization techniques involving the formation of interpolymers having a controlled type of steric arrangement of the polymerized monomers, i.e. random, block, tapered, etc. Hydrogenation of the interpolymer is effected using conventional hydrogenation processes.

Hydrogenated alkenylarene-conjugated diene interpolymers of relatively high molecular weight are suitable herein. Such high molecular weight interpolymers include those which can be characterized as having a $\overline{M}_w$ of $10^4$ up to $10^7$. Preferred interpolymers have $\overline{M}_n$ in a range of between about 30,000 and about 150,000. Such interpolymers are known in the prior art.

Suitable alkenylarene monomers include, vinyl mono-, di- or polyaromatic compounds, such as a styrene or a vinyl naphthalene monomer. The preferred alkenylarene monomers are styrene, and substituted styrenes, such as alkylated styrene, or halogenated styrene. The alkyl group in the alkylated styrene, which may be a substituent on the aromatic ring or on an alpha carbon atom, may contain from 1 to about 20 carbons, preferably 1–6 carbon atoms. Suitable conjugated diene monomers include butadiene and alkyl-substituted butadiene, having from 1 to about 6 carbons in the alkyl substituent. Thus, in addition to butadiene, isoprene, piperylene and 2,3-dimethylbutadiene are useful as the diene monomer. Two or more different alkenylarene monomers as well as two or more different conjugated diene monomers may be polymerized to form the alkenylarene-conjugated diene interpolymers. The majority of these interpolymers known in the prior art are copolymers prepared from one type of each monomer.

A number of hydrogenated alkenylarene-conjugated diene interpolymers are known in the prior art to be effective viscosity index (V.I.) improvers for lubricating oils.

U.S. Pat. Nos. 3,554,911; 3,630,905 and 3,772,169 are concerned with the use of hydrogenated random butadiene-styrene copolymers as V.I. improvers for lubricating oils. These copolymers are prepared by the copolymerization, using conventional techniques, of butadiene and styrene in the presence of a randomizing agent and subsequently, the copolymers are partially hydrogenated. The hydrogenated copolymers have a $\overline{M}_w$ from about 10,000 to about 125,000; preferred range of from 30,000 to 100,000. These copolymers contain butadiene in the range of from 30% to 44% by weight with the remainder being styrene. Prior to hydrogenation, the copolymers have a vinyl content of less than 35% by weight. During hydrogenation, the olefinic group hydrogenation is 95% by weight or more, and the phenyl group hydrogenation is 5% by weight or less.

U.S. Pat. No. 3,752,767 teaches of a V.I. improver of hydrogenated random copolymers of a conjugated diene and a vinyl aromatic compound, in which the diene and/or the vinyl aromatic compound contains at least one alkyl substituent. These copolymers are further defined as derived from a $C_{4-6}$ conjugated diene and a styrene in which the diene and/or styrene contains at least one lower $C_{1-6}$ alkyl substituent. Dienes include piperylene, 2,3-dimethylbutadiene, isoprene and butadiene. The vinyl aromatic compound is styrene or an alkylated styrene. In the alkylated styrene, the alkyl substituent may be attached to either the alpha-carbon of the styrene, i.e., alpha-methylstyrene, or to the aromatic ring, i.e., p-methylstyrene. The molar ratio between the conjugated diene and the vinyl aromatic compound varies depending upon the nature of the vinyl aromatic component, since the oil-solubility depends upon the presence or absence of an alkyl substituent in the vinyl aromatic compound. Thus, when the vinyl aromatic compound consists entirely of styrene, up to about 70 molar percent styrene may be utilized. When the vinyl aromatic compound contains an alkyl group of sufficient oil-solubilizing properties, e.g., p-t-butylstyrene, up to about 90 molar percent may be used. These copolymers are prepared by copolymerization, using conventional techniques, of the appropriate vinyl aromatic and conjugated diene compounds in the presence of a randomizing agent and subsequently, the copolymers are partially hydrogenated. In the hydrogenated copolymer, it is preferred that more than 95% of the olefinically unsaturated bonds and less than 5% of the aromatic unsaturation originally present in the random copolymer is saturated in the final hydrogenated random copolymer. The $\overline{M}_w$ is in the range from $10^4$ to $10^7$.

U.S. Pat. No. 3,775,329 is concerned with the use of hydrogenated tapered copolymers of isoprene and a monovinyl aromatic compound as V.I. improvers for lubricating oil. These tapered copolymers are defined as including both "single tapered copolymers" and "multiple tapered copolymers". These particular copolymers are derived from isoprene and a vinyl mono-, di-, or polyaromatic compound, such as a styrene or a vinyl naphthalene. The preferred vinyl aromatic monomers are styrene, alkylated styrene, e.g. para-t-butyl styrene, or halogen-substituted styrene. The copolymers are prepared by the copolymerization, using conventional techniques, of the appropriate monomers, and subsequently, the copolymers are hydrogenated using conventional techniques to the desired degree of hydrogenation. It is preferred that 95% of the olefinic unsaturated bonds originally present in the tapered copolymer and less than 5%, of the aromatic unsaturation is saturated in the final hydrogenated tapered copolymer. The $\overline{M}_w$ may vary between $10^4$ to $10^7$ and preferably in the range of from 20,000 to 200,000.

Other block copolymers include:

U.S. Pat. No. 3,668,125 to the use as a V.I. improver for lubricating oil of certain hydrogenated block copolymers of a conjugated diene and a vinyl aromatic compound;

U.S. Pat. No. 3,668,125 is concerned with hydrogenated block copolymers having at least three essentially uniform polymer blocks, C and D wherein C represents a hydrogenated monovinyl arene, i.e. styrene, polymer block and D represents a hydrogenated conjugated diene, i.e., butadiene or isoprene, polymer block; and, U.S. Pat. No. 3,763,044 patent is concerned with a block copolymer corresponding to the general formula, A-B, wherein A represents a polymer block of the group consisting of polystyrene and hydrogenated polystyrene products having a $\overline{M}_w$ of from 5,000 to 50,000 and B represents a block of hydrogenated polyisoprene having a $\overline{M}_w$ of $10^4$ to $10^6$.

The above discussed patents are incorporated herein by reference to identify and to illustrate both general and specific types of hydrogenated alkenylarene-conjugated diene interpolymers useful as viscosity index improvers, which may be used to prepare the additive solutions and lubricating compositions of the present invention. Included herein also are graft copolymers of polystyrene and 15 to 50 wt.% of a polyisobutylene comprising a polystyrene backbone of molecular weight 50,000 to 1,000,000 having joined thereto polyisobutylene groups of molecular weight 1,000 to 20,000 whereby each polyisobutylene group is attached to the polystyrene backbone.

Hydrogenated Conjugated Diolefin Polymers

These polymers are derived from conjugated dienes having from 4 to 6 carbon atoms, most usefully, butadiene. Examples are homopolymers of 1,3-butadiene, isoprene, 1,3-pentadiene, 1,3-dimethylbutadiene, copolymers formed with at least two of these conjugated dienes and copolymers of the latter with styrene, these homopolymers and copolymers having been hydrogenated up to the above-mentioned residual unsaturation degree. More particularly, the hydrogenated polymer may be obtained from:

a polymer of 1,3-butadiene, initially containing from 25 to 80% of 1,2 units;

a copolymer containing from 10 to 90% of butadiene units and from 10 to 90% of isoprene units; or, a copolymer containing from 20 to 80% of units derived from a conjugated diene having from 4 to 6 carbon atoms and 20 to 80% of styrene units.

These polymers or copolymers may be prepared, for example, in solution in an aliphatic or cycloaliphatic solvent according to various techniques described in the prior art. They are preferably prepared by catalysis in the presence of alkali metals derivatives in order to obtain products having a narrow range of distribution of the molecular weights.

The hydrogenation may also be conducted according to conventional techniques, for example in the presence of catalysts containing Raney nickel, platinum, or palladium, deposited on carbon, or still with systems obtained by reaction of transition metal derivatives, such as nickel or cobalt carboxylates or acetylacetonates, with organoreducing compounds such as organoaluminum or organolithium compounds or their hydrides.

Highly useful is a hydrogenated copolymer of butadiene and isoprene wherein the weight ratio of butadiene to isoprene is between about 10:90–70:30, from about 30% to about 55% of the precursor copolymer units are in the 1,4-configuration and wherein the olefinic bonds are substantially saturated by hydrogenation, the average molecular weight of the copolymer being from about 40,000 to about 225,000. Of course, it is understood that the copolymer includes random, tapered and block copolymers.

The copolymers may be usefully grafted (by reaction in the presence of a compound generating free radicals) with from 1 to 40 wt.% more usually 1 to 10 wt.% of a polymerizable vinyl compound such as vinyl acetate, N-vinylpyrrolidone, various acrylates and methacrylates.

THE ESTER BASED POLYMERS

Usually these V.I. improving, oil-soluble ester based polymers will have molecular weights in the range of $10^4$ to $10^7$, preferably 50,000 to 500,000 and most preferably, 50,000 to 200,000 $\overline{M}_w$. These ester based polymers are derived essentially, e.g., 80 wt.% or more of the total polymer, from $C_8$ to $C_{20}$, preferably $C_{12}$ to $C_{18}$, alkyl esters of a $C_3$ to $C_8$, preferably $C_3$ to $C_5$ mono- or dicarboxylic, monoethylenically unsaturated acid. V.I. polymers of this ester based type are well known in the art and are usually made by free radical initiation, e.g., a peroxide, in a solvent.

Such esters from which the polymer is essentially derived include: alkyl acrylate; alkyl methacrylate; dialkyl fumarate; and dialkyl itaconate.

The most common of these V.I. improvers are polymers of acrylic esters represented by the formula

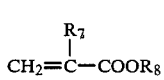

(5)

wherein $R_7$ represents hydrogen or methyl and $R_8$ represents an oil-solubilizing group, especially an alkyl group of 8 to 24 carbon atoms. The alkyl group may be essentially straight chain and preferably contains 12 to 18 carbon atoms although methyl and ethyl branching can be tolerated. Representative polyacrylic and polymethacrylic esters that promote oil solubility comprise octyl, decyl, isodecyl, dodecyl, isododecyl, myristyl, cetyl, stearyl, eicosyl and tetracosyl polyacrylates and polymethacrylates. The term "acrylic ester" in this invention includes both acrylates and methacrylates. Mixtures of both alkyl acrylates and alkyl methacrylates may be used as well as their partial esters.

Lower alkyl acrylic esters, here meaning esters having alkyl groups smaller than 8 carbon atoms and derived from acrylic or methacrylic acid, are of particular interest, because in general they possess polymerizing characteristics similar to the acrylic esters which supply oil-solubility. Presence of small alkyl groups in copolymers may help improve the property of viscosity index. Typical lower acrylic esters are methyl, ethyl, propyl, butyl, amyl, and hexyl acrylates and methacrylates. These lower alkyl acrylic esters may be employed in amounts ranging from 0 to 25 mole %.

In addition to the one or more of the above vinyl mono- and dicarboxylic esters possessing oil-solubilizing groups and the aforementioned lower alkyl acrylic esters, there may be used to form the backbone; in minor amounts, one or more other miscellaneous free radical, polymerizable, monoethylenically unsaturated compounds, particularly monovinylidene compounds, i.e., those having one $CH_2{=}C$ group in its structure, such as vinyl esters such as vinylacetate, styrene and alkyl styrenes, vinyl alkyl ethers—which are represented by vinyl butyl ether, vinyl dodecyl ether and vinyl octadecyl ether.

In addition, nitrogen-containing monomers can be copolymerized with the foregoing monomers, said nitrogen-containing monomers include those represented by the formula:

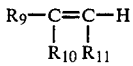

(6)

wherein $R_{10}$ and $R_{11}$ can be hydrogen and/or alkyl radicals and $R_9$ is a 5- or 6-membered heterocyclic nitrogen-containing ring and which contains one or more substituent hydrocarbon groups. In the above formula, the vinyl radical can be attached to the nitrogen or to a carbon atom in the radical $R_9$. Examples of such vinyl derivatives include 2-vinylpyridine, 4-vinylpyridine, 2-methyl-5-vinylpyridine, 2-ethyl-5-vinylpyridine, 4-methyl-5-vinylpyridine, N-vinylpyrrolidone, 4-vinylpyrrolidone and the like.

Other monomers that can be included are the unsaturated amides such as those of the formula:

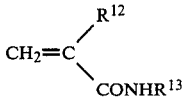

(7)

wherein $R^{12}$ is hydrogen or methyl, and $R^{13}$ is hydrogen or and alkyl radical having up to about 24 carbon atoms. Such amides are obtained by reacting acrylic acid or a low molecular weight acrylic ester with an amine such as butylamine, hexylamine, tetrapropyleneamine, cetylamine and tertiary-alkyl primary amines. The tertiary-alkyl primary amines referred to conform to the characterizing structure

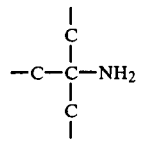

(8)

wherein a tertiary carbon atom, i.e., one devoid of hydrogen atoms is bonded to a primary amino radical, i.e., —$NH_2$. Such tertiary-alkyl primary amines should contain at least about 6 and generally not more than about 24 carbon atoms in the tertiary-alkyl substituent. In most instances, the tertiary-alkyl substituent will contain from about 10 to about 24 carbon atoms. Specific examples of tertiary-alkyl primary amines useful for the purposes of this invention include tertiary-octyl primary amine, tertiary-decyl primary amine and tertiary-hexadecyl primary amine, tertiary-eicosyl primary amine and tertiary-triacontyl primary amine. It is not necessary to use a single tertiary-alkyl primary amine; in fact, it is generally more convenient to use a commercial mixture of such amines wherein the tertiary-alkyl substituent contains from about 10 to about 24 carbon atoms. A typical mixture of such commercial tertiary-alkyl primary amines, for example, consists of tertiary-alkyl primary amines containing from about 12 to about 14 carbon atoms, said mixture averaging about 12 carbon atoms per amine molecule.

Still other monomers that can be included are amides and mixed amides-esters of the vinyl monocarboxylic and dicarboxylic acids earlier referenced herein. These monomers and the earlier discussed lower alkylacrylic esters, monovinylidene compounds, nitrogen containing monomers and unsaturated amides may individually or collectively employed in total amounts ranging from 0 to 25 mole percent.

In addition to the other representative macromolecular polydisperse polymers previously set forth, there is to be added the alkenyl polyethers and silicones.

ALKYLENE POLYETHERS

These polyethers are the products of polymerization or telomerization of cyclic oxides containing from two to eight carbon atoms and having a ring of one oxygen atom and 2 or 3 carbon atoms thus conforming to the structural formula

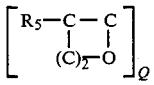

wherein $R_5$ is an alkyl radical containing from 2 to 18 carbons and z is 0 or 1 (see U.S. Pat. No. 3,634,244) and Q provides a ($\overline{M}_2$) ranging from $10^4$ to $10^7$.

Representative of another polyether is a polyoxyalkylene glycol diether having the general formula

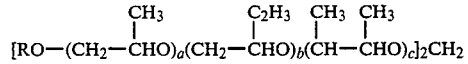

wherein R is a hydrocarbon radical shown by the general formula: $C_nH_{2n+1}$, $C_nH_{2n-1}$, $C_nH_{2n-3}$ or $C_nH_{2n-5}$, n an integer of 1-24, $$K = \frac{b+c}{a+b+c}, N \geqq 6\text{-}5K$$

a+b+c is an integer of 5-100 and a or b+c may be 0 but a, b and c are not 0 at the same time.

Production is by random or block polymerization of an alcohol of $C_{1-24}OH$ with propylene oxide or butylene oxide then conversion to a sodium salt and then etherification by means of dihalomethane.

SILICONES

This includes a large group of organosiloxane polymers based on a structure consisting of alternate silicon and oxygen atoms with various organic radicals attached to the silicon which can be represented as follows:

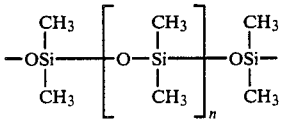

and generally derived from the polymerization of methylchlorosilanes while admixed with water or the reaction of $SiCl_4$ and a Grignard reagent with subsequent hydrolysis and polymerization.

Silicone polymers can form flexible ring-like structures which allow for scission of the first bond resulting in a compensating increase in intrinsic viscosity even though the polymer suffers mechanical shear degradation.

Molecular Weight Distribution (MWD) and Topology

MWD and topological variations can be produced in polymers of the chemical repeat unit types discussed above. The variety of polymers produced for a given repeat unit will be goverened partially by the catalyst type and kinetics which are active for that unit.

Those catalysts and monomers which are characterized as "living" polymerizations may be used to make narrow (Poisson) distribution $$\left(\frac{\overline{M}_z\overline{M}_{z+1}}{M_w^2} \sim 1.\right)$$

polymers. Furthermore, the topological variations of rings, loops, star and comb branched as well as random branched polymers may be formed by appropriate utilization of multifunctional initiators and terminating agents. These are most often anionic polymerizations.

Appropriate use of cationic catalysis can be used to prepare saturated hydrocarbon polymers of most probable molecular weight distribution $$\left(\frac{\overline{M}_z\overline{M}_{z+1}}{M_w^2} \approx 3\right)$$

and with appropriate multifunctional initiators for star, graft or randomly branched polymers.

Olefin metathesis reaction polymerizations may be used to prepare blends of rings and linear polymers.

Ziegler catalysis are most appropriate for randomly branched and loop containing polymers.

Siloxane ring-chain equilibrium may be used, including copolymers of siloxane and links with other monomers.

Reactor design, e.g. continuous stored tanks, plug flow or staged stirred tanks may be used to modify MWD during initial polymerization.

The above polymers may be altered in their molecular topology and molecular weight distribution by a number of chemical or mechanical/chemical reactions conducted on the polymers. These include graft polymerization reactions, inter- and intramolecular crosslinking reactions, chain cleavage reactions and combinations of these reactions. Terminally functional polymers may be coupled into rings or branched structures. The reactions may be carried out in solution or in the bulk. Dilute solution will tend to maximize intramolecular reactions, e.g. crosslinking of polymer chains in solution will lead to loops and rings within the chain.

Lubricating Base Stock

This invention is applicable to improvement of the operational performance of lubricating oil base stocks which have been compounded with a V.I. additive, e.g. a V.I. ethylene copolymeric additive and if desired with various other oil additives including: ashless dispersants such as the reaction product of polyisobutenyl succinic anhydride with tetraethylene pentamine; detergent type additive such as barium nonyl phenol sulfide, calcium petroleum sulfonate, nickel oleate, an antioxidant such as a phenolic antioxidant; pressure additive such as a zinc dialkyl dithiophosphate; an antirust agent, etc.

Base Stock oils for the preparation of lubricating oils can be prepared from vacuum distillation fractions or residues of the vacuum distillation of crude mineral oils. These oils can also be prepared by hydrocracking mineral oil and subsequently hydrogenating the products with the object of increasing their oxidative stability which provides a heavy hydrotreated blending component.

The lubricating oils to which the polymeric solutions of the invention can be added include not only mineral lubricating oils, but synthetic oils also. The nonhydrocarbon synthetic oils include dibasic acid esters such as di-2-ethyl hexyl sebacate, carbonate esters, phosphate esters, halogenated hydrocarbons, polysilicones, polyglycols, glycol esters such as $C_{13}$ Oxo acid diesters of tetraethylene glycol, etc.

Measurement of Compliance

Both viscosity and compliance are conveniently measured by a variety of equivalent techniques such as cone and plate rheometry as described in K. Walters "Rheometry" Wiley NY 1975 p. 60ff. Commercial equipment such as the Rheometrics Mechanical Spectrometer (Rheometrics Inc., Union, NJ) can be employed. For each polymer of a particular repeat unit type, and molecular weight $\overline{M}_w$, when dissolved in the lubricating fluid at concentration, c, there will be a value of $J_e°$. Fluids are viscosity modified to produce a given viscosity $\eta°$. This requires that the product of concentration c and intrinsic viscosity, $[\eta]$, for the polymer be a prescribed value. $[\eta]$ depends on molecular weight and topology. For fixed c and $[\eta]$ there will be a value of $J_e°$. For linear polymers this value will have a minimum value of $\overline{M}_z\overline{M}_{z+1}/\overline{M}_w^2$ is one, i.e. all molecules have the same molecular weight. For polymers with a MWD, $J_e°$ is increased as described by $\overline{M}_z\overline{M}_{z+1}/\overline{M}_w^2$. Shear stability decreases as this quantity increases, and has attained an unsatisfactory level when it is 10. For this reason, this value should be 1 to up to 10, such as 1 to 8, preferably 1 to 5, optimally 1 to 3 and most optimally 1 to 2 or less.

As previously noted $J_e°$ can be measured or estimated theoretically. By theory for a linear polymer (Rouse Model)

$$J_e^\circ = 0.4\frac{M}{cRT}\left(\frac{\eta^\circ - \eta_s}{\eta^\circ}\right)^2$$

Thus, for a fluid at 23° C. with c=1 gm/100 ml and $\eta°=2\eta_s$, $J_e°=4.\times10^{-10}$M cm$^2$/dyne. This relationship is independent of polymer repeat unit type. Due to differences in the dependence of $\eta°$ on M, solutions formulated from different polymer type will have different compliances and it is not possible to specify a single value encompassing all polymer classes. It is apparent that for given chemical stability, polymers which have high capacity to thicken oil for a given molecular weight will be those that mechanically are most stable. Such properties are attainable by having low molecular weight per backbone bond, good thermodynamic interaction of polymer with the modified fluid or a stiff polymer chain as caused by short range intramolecular interactions.

The following examples demonstrate the principles of this invention.

EXAMPLE 1

In this Example, it is shown that $J_{eR}°$ for solutions of nearly monodisperse linear and four-arm star branched polybutadienes follow the relationship $$J_{eR}^\circ = J_e^\circ cRT\frac{\eta^{\circ 2}}{(\eta^\circ - \eta_s)^2}$$

with $J_{eR}°$ given as calculated in the J. S. Ham reference cited, i.e. that the compliance and thus the normal stresses in the solution of the branched polymer at the same $\eta°$ are lower and furthermore that the susceptibility of the branched polymer to sonic degradation is less.

Four polybutadiene samples were purchased from L. J. Fetters of the U. of Akron. These were prepared by standard anionic living polymerization techniques. They were characterized by gel permeation chromatography and membrane osmometry as shown in Table I.

$$\frac{\overline{M}_z\overline{M}_{z+1}}{\overline{M}^2}$$

is less than 1.4 and the polymers are treated as being monodisperse.

TABLE I

| | | | PRIMOL[(a)] SOLUTIONS | | |
|---|---|---|---|---|---|
| Sample | Type | M | c g/10$^2$g solution | $\eta°/\eta_s$ | $J°_{eR}$ |
| A | Linear | $2.3 \times 10^5$ | .74 | 1.84 | .40 |
| B | Linear | $1.5 \times 10^5$ | 1.09 | 1.96 | .44 |
| C | 4-arm star | $3.6 \times 10^5$ | .77 | 1.75 | .24 |
| D | 4-arm star | $2.1 \times 10^5$ | 1.06 | 1.72 | .22 |

The molecular weights of the polymers were chosen so that solutions could be formulated to approximately the same concentration and viscosity. Solutions were prepared in a white mineral oil, Primol, (containing 0.5% butylated hydroxytoluene (BHT)) to the concentrations shown in Table I. These solutions were investigated by W. Philippoff using glass capillary viscometers and flow birefringence. The latter technique can be used to measure compliances. Results of these experiments were reported (Bulletin, Soc. of Rheology, Oct. 1978). In Table I are reported the values obtained for $J_{eR}°$ which are in essential agreement with the theoretical estimates of 0.4 and 0.18 (J. S. Ham. *J. Chem. Phys.*, 26, 625 (1957)). Thus it is experimentally shown that polymer solutions in this $[\eta]c$ range yield results in reasonable agreement with theory.

These solutions were sonically degraded by procedure ASTM D2603 (10 minutes at 0.8 Amp and 40° C.). Such a technique is known to correlate with inservice oil performance. Kinematic viscosities of the solutions measured at 210° F. were measured before and after sonication and the viscosity loss is calculated as $(\eta^{\circ original} - \eta^{\circ recorded}/\eta^{\circ original}$. If this quantity is correlated with the molecular weight of the polymers, it is found that the branched polymers degrade less at a given molecular weight as shown in Table II.

TABLE II

| Polymer | Viscosity Loss | Normal Stress dynes/cm$^2$ at shear Stress $10^3$ dynes/cm$^2$ |
|---|---|---|
| A | 9.4 | 247 |
| B | 2.3 | 110 |
| C | 5.8 | 180 |
| D | 1.4 | 63 |

Instead of correlating with molecular weights, use of the normal stresses exhibited by the solutions at a given shear-stress to calculate maximum stored energy per bond results in a correlation which is independent of molecular topology.

EXAMPLE 2

In this Example, it is shown that a similar resistance to degradation exists for another topological class of polymers, that of comb branched polystyrenes. Linear polystyrene samples were purchased from Pressure Chemicals Co. (Smallman St., Pittsburgh, PA), Duke Scientific (California) and branched polystyrenes were obtained from Roovers. Characteristics of the linear polymers are supplied by the manufacturer whereas those for the comb branched polymer have been published (*Macromolecules* 11, 365 (1978)) and are given In Table III. Solutions were prepared in 1,2,4-trichlorobenzene, containing 0.05% inhibitor (BHT) to the concentrations shown in Table III.

TABLE III

| Sample | Polystyrene in Molecular Weight | Number of Branches | $\eta°$ 37.5° C. cstokes | Visc. Loss |
|---|---|---|---|---|
| 4a | $9.7 \times 10^4$ | 0 | 1.5 | 3.5 |
| 13a | $6.7 \times 10^5$ | 0 | 12. | 68 |
| 14b | $2.0 \times 10^6$ | 0 | 18. | 82 |
| Duke 501 | $4.1 \times 10^6$ | 0 | 42 | 94 |
| C752 | $3.6 \times 10^6$ | 28 | 5.2 | 57 |
| C652 | $3.1 \times 10^6$ | 29 | 7.5 | 68 |

The solutions were tested for viscosity loss as in Example 1 (0.8 amp 5 minutes 40° C.). As was the case in Example 1 the branched polymers degrade significantly less at a given molecular weight. Certain of these solutions had similar viscosities as in Example 1 if the linear and branched structures which have similar viscosity modifying characteristics are compared it is found that the susceptibility to degradation is similar. Thus comb polymers with large numbers of branches are not as shear stable as four-arm stars.

EXAMPLE 3

In this Example, linear polymers are formulated to prescribed MWD by blending polymers of known characteristics. It is shown that the criterion of $\overline{M}_z \cdot \overline{M}_{z+1}/\overline{M}_w^2 \leqq 10$ is a better measure of degradability than is $\overline{M}_w/\overline{M}_n \leqq 8$ as previously taught.

Four linear ethylene-propylene copolymers were used whose characteristics appear in Table IV. These samples were characterized by vapor phase osmometry, membrane osmometry and gel permeation chromatography (GPC) with on-line low angle laser light scattering (LALLS). All samples had ethylene contents in the 40–50 wt. % range and were prepared by continuous flow stirred reactor processes that results in a most probable distribution of molecular weights to a good approximation.

TABLE IV

| Polymer | $\overline{M}_n$ | $\overline{M}_w$ | $\overline{M}_z$[1] | $\overline{M}_{z+1}$[1] | $[\eta]$135° C. Decalin |
|---|---|---|---|---|---|
| A | $9. \times 10^2$ | $1.8 \times 10^3$ | $2.7 \times 10^3$ | $3.6 \times 10^3$ | .06 |
| B | $2.5 \times 10^4$ | $5. \times 10^4$ | $7.5 \times 10^4$ | $1. \times 10^5$ | 1.0 |
| C | $6.7 \times 10^4$ | $1.35 \times 10^5$ | $2.0 \times 10^5$ | $2.7 \times 10^5$ | 2.0 |
| D | $1.5 \times 10^5$ | $3.0 \times 10^5$ | $4.5 \times 10^5$ | $6. \times 10^5$ | 3.5 |
| E | $3.7 \times 10^5$ | $9.10 \times 10^5$ | $1.2 \times 10^6$ | $1.8 \times 10^6$ | 8.2 |

[1]Calculated from distribution and $\overline{M}_w$

For such a MWD when analysis is done with a GPC which has an approximately linear elution volume log M calibration, the peak in the light scattering chromatogram corresponds to $\overline{M}_z$. Thus the power of the technique to detect high molecular weight averages is apparent.

Blends of the polymers in Table IV were formulated as shown in Table V. Solutions of these blends were formulated in a mineral lubricating oil ENJ 102. All had the same $[\eta]=2$ and thus the same thickening efficiency. These solutions were tested for kinematic viscosity and degraded as a Example 1 with the results shown in Table V. It is apparent that the group $$\frac{\overline{M}_z\overline{M}_{z+1}}{\overline{M}_w^2}$$

is a sensitive test of degradability and that $\overline{M}_w/\overline{M}_n$ which is taught in previous art fails to predict degradability in both a false positive and negative fashion.

TABLE V

| | | $\frac{\overline{M}_z\overline{M}_{z+1}}{\overline{M}_w^2}$ | $\frac{\overline{M}_w}{\overline{M}_n}$ | Calculated $J°_e$ cm$^2$/dyne[1] | % Loss |
|---|---|---|---|---|---|
| Control | Polymer C | 3 | 2 | $1.6^{-4}$ - | 31. |
| Blend A | A:C:D .06:.9:.04 | 3.4 | 11. | $1.8 \times 10^{-4}$ | 31. |
| Blend B | B:E ..86:.14 | 55 | 6. | $29 \times 10^{-4}$ | 46. |

[1]Monodisperse polymer would have $J°_e = 5. \times 10^{-5}$ cm$^2$/dyne.

Since it has been shown that this invention is applicable to a wide range of polymer types and diverse topology, it becomes credible to predict the behavior of varying comparative polymeric structures and types as illustrated in the following:

(A) A solution can be prepared from a polymer which is in the form of large flexible rings. The compliance would be a smaller value than that of a linear polymer of the same molecular weight as calculated in Table VI. The ring containing polymer would be more resistant to bond breakage upon mechanical stress compared to the linear counterpart. When bond rupture occurs the viscosity $\eta^\circ$ of the ring polymer containing solution increases.

TABLE VI

| Polymer | Type | $\overline{M}_w$ | $[\eta]$ | $J^\circ/(J^\circ)$Linear |
|---|---|---|---|---|
| A | Linear | $1. \times 10^5$ | 1.8 | 1 |
| B | ring | $1.37 \times 10^5$ | 1.8 | .66 |

(B) A polymer solution can be formulated to be within the range $0.1<[\eta]c<5$ from a blend of polymers of type A and B of the preceding (A). When the polymer bonds are broken upon mechanical degradation the viscosity of the solution $\eta^\circ$ would remain essentially constant due to a concurrent increase in $[\eta]$ of the ring polymer upon bond breakage.

(C) A polymer solution can be formulated in the range $0.1<[\eta]c<5$ using a polymer that was intramolecularly crosslinked in dilute solution forming large loops and branched structures. The resulting solution would be more stable to degradation than the solution of a linear polymeric counterpart of the same $[\eta]$ and c due to the reduced compliance of the loop containing polymer.

(D) A polymer which contains functional groups or repeat units can be partially ionized or otherwise be made particularly compatible with the fluid to be viscosity modified resulting in a highly extended conformation of the polymer in solution, e.g. a 1 wt.% of sulfonated (~2% sulfonation) polystyrene in dimethyl formamide. Such polymers are extremely effective at increasing solution viscosity and thus may be used at low $\overline{M}_w$ and therefore very low $J_e^\circ$ with resulting good shear stability of the resulting solution.

The invention in its broader aspect is not limited to the specific details shown and described and departures may be made from such details without departing from the principles of the invention and without sacrificing its chief advantages.

What is claimed is:

1. A mineral lubricating oil fluid containing a major amount of mineral lubricating oil and about 0.5 to 10 weight % of a soluble non-linear macromolecular polydisperse polymer as a V.I. improver dissolved in and at a concentration c such that $0.1 \leqq [\eta]c \leqq 5$ where $[\eta]$ is the intrinsic viscosity of said polymer in that fluid, wherein such fluid exhibits enhanced stability to mechanical shear due to the fact that $$\frac{\overline{M}_z\overline{M}_{z+1}}{\overline{M}_w^2}$$

of the polymer is 3 or less and the reduced compliance of the fluid is less than ten times that of a linear monodisperse polymer in the fluid of the same chemical structure, concentration and $\overline{M}_w$ of said polydisperse polymer, and said polydisperse polymer being selected from the class consisting of ethylene containing polymer consisting of 30 to 80 wt. % ethylene and the balance propylene having a degree of crystallinity of less than 25 wt. % and a $\overline{M}_w$ in the range of about $10^4$ to $10^7$, polybutadiene, polystyrene, poly(alkylated styrene), ester based polymers and alkylene polyethers, wherein said ethylene containing polymer is characterized by the presence of topological nonlinearity as evidenced by long chain branches, flexible rings or loops in the contour of said ethylene containing polymer, and wherein said polybutadiene, polystyrene, poly(alkylated styrene), ester based polymers and alkylene polyethers are each characterized by combs, flexible rings or loops in their contours, and wherein said long chain branches and combs contain 100 or more backbone carbon atoms.

2. A lubricating composition according to claim 1, wherein said compliance ratio is no larger than 5.

3. A lubricating composition according to claim 1, wherein said compliance ratio is no larger than 3.

4. A lubricating composition according to claim 1, wherein said compliance ratio is no larger than 2.

5. A lubricating composition according to claim 1, wherein said polymer is said non-linear polymer characterized by long-chain branches.

6. A lubricating composition according to claim 5, wherein said long-chain branches are formed by crosslinking.

7. A lubricating composition according to claim 5, wherein said long-chain branches are the arms of a four arm star.

8. A lubricating composition according to claim 5, wherein said long-chain branches are defined by a comb branched polymer.

9. A lubricating composition according to claim 1, wherein said polymer is said non-linear polymer characterized by rings or loops.

10. A composition according to claim 8, wherein said comb branched polymer is comb branched polystyrene.

* * * * *